United States Patent [19]

Swain

[11] Patent Number: 4,920,579

[45] Date of Patent: May 1, 1990

[54] APPARATUS TO RESTRAIN NECK TIE TAILS

[76] Inventor: Eugene D. Swain, Box #100, R.D. #1, Weirton, W. Va. 26062

[21] Appl. No.: 176,722

[22] Filed: Apr. 1, 1988

[51] Int. Cl.[5] ..... A41D 25/00

[52] U.S. Cl. ..... 2/145; 24/49 CF

[58] Field of Search ..... 24/49 R, 49 CF, 49 M, 24/50, 56, 58; 2/144, 145

[56] References Cited

U.S. PATENT DOCUMENTS

| | | | |
|---|---|---|---|
| 2,749,553 | 6/1956 | Miller | 2/145 |
| 3,042,983 | 7/1962 | Riedler | 24/49 CF |
| 3,151,371 | 10/1964 | Ellestad | 24/56 |

FOREIGN PATENT DOCUMENTS

| | | | |
|---|---|---|---|
| 2597731 | 10/1987 | France | 24/49 CF |
| 3493 | of 1906 | United Kingdom | 24/49 CF |

*Primary Examiner*—James R. Brittain

*Attorney, Agent, or Firm*—Clifford A. Poff

[57] ABSTRACT

A tie restraint apparatus for holding a tie tail portion of a four-in-hand neck tie at the front portion of a shirt. The tie tail is an elongated end portion of a neck tie and includes transversely extending fabric strip secured at spaced apart sites to a back surface of the tail portion. The tie restraint apparatus includes elongated plastic strip having an opening at each spaced apart locations for support by attachment to spaced apart buttons on the front portion of the shirt. The plastic strip is dimensioned to extend between the fabric strip and the tail portion of the neck tie for centrally positioning and restraining movement of the tail portion of the neck tie at the front portion of the shirt.

4 Claims, 1 Drawing Sheet

APPARATUS TO RESTRAIN NECK TIE TAILS

BACKGROUND OF THE INVENTION

1. Field of the Invention:

This invention relates to apparatus to restrain the end portion of a four-in-hand neck tie along the front portion of the uses the article of clothing, and more particularly, the present invention provides an apparatus for operative engagement with a transverse member such as a sewn in place label extending across the back of the end portion of a neck tie to constrain and provide limited lateral and parallel movements of a neck tie end portion while the apparatus is supported by spaced apart fasteners at the front of the user shirt.

2. Description of the Prior Art:

Heretofore a neck tie of the type commonly referred to in the art as a four-in-hand neck tie presented tie tails which comprise a wide end portion and a narrow end portion, that could be held in place at the front of the users shirt or other garment by a tie tack, tie clasp or other article. Such holding devices are usually selective by preference and sometimes according to a fashion trends. Some forms of devices known of the art for securing one or both tie tails in front of the user's shirt can be found in U.S. Pat. Nos. 3,453,696; 3,529,327; and 4,554,710. These forms of neck tie holders anchor at least one of the tie tails to the user's shirt. Torso movements by the user are likely to cause the anchored tie tail to pull on the remaining part of the tie particularly the tie knot causing a tighten and/or displacement of the knot whereby the tie no longer presents the desired ascetic appearance. In U.S. Pat. No. 4,554,710 there is shown a tie tack which includes a cross bar member that is anchored by inserting the bar member into a button hole of the shirt. At the free end of the tie tack there is one part of a hook and loop fastener to engage with a second part of the fastener extending across the back surface of the tie tail. Adhesive is used to attach the part of the hook and loop fastener to the tie. The adhesive may cause a unwanted discoloration and the integrity of the adhesive is a difficult to assure particularly with respect to attachment to a fabric material. U.S. Pat. No. 3,827,108 discloses spiral shaped loops which encircle the tie tails and engage with a shirt button for support.

SUMMARY OF THE INVENTION

It is the object of the present invention to provide apparatus to maintain one or both end portions of a four-in-hand tie in a straight line relation down the front of a user shirt while permitting a restricted displacement from this relation by movement of the wearer.

It is further object of the present invention to provide an apparatus for holding a tie tail of a four-in-hand neck tie in place while being completely hidden from view under normal movements of by the user.

It is another object of the present invention to provide a tie holding apparatus which embodies a design and construction of parts to permit permanent attachment to the neck tie to avoiding loss of the apparatus and always present the apparatus for immediate to hold the tie tail portion in place.

It is another object of the apparatus to provide to maintain the tie tails of a four-in-hand tie in a generally straight line position down the front of a users shirt while allowing only relatively a small lateral movement while the user undergoes movement from sitting, bending standing or the like so as to prevent the development of forces tending to pull the tie tail and cause dislodgement of the tie knot or other portions of the tie from the originally intended preset location.

It is another object of the present invention to provide an apparatus to hold a tie tail portion through attachment through of the apparatus to any two buttons which are normally cover by the tie tail when located in the desired position, such buttons being preselected to prevent pulling of the tie tail by the apparatus through embodiments.

More particularly according to the present invention there is provided a tie restraint apparatus for holding a tie tail portion of a four-in-hand neck tie at the front portion of a shirt, said tie tail being an elongated end portion of said neck tie and having a transversely extending strip secured at spaced apart sites to a back surface of said tail portion, the tie restraint apparatus including elongated means having an opening at each spaced apart locations there along for support by attachment to spaced apart fastening members on the front portion of the shirt. The elongated means being dimensioned to extend between the strip and the tail portion of the neck tie for centrally positioning with limited longitudinal movement of the tail portion of the neck tie at the front portion of the shirt.

Preferably, the fastening members by which the apparatus is attached to the users shirt comprise buttons of the shirt and the openings in the restraint apparatus comprise button holes to receive the buttons of the shirt. The elongated means preferably takes a form of a preselected length of a flexible strip although two lengths of such material can be selected and supported by the shirt buttons. The two lengths of flexible material will extend along opposite side of the transverse strip on the tie tail. A single length of flexible strip material can be selected and provided a transverse fold line equal distance from terminal end portions. The end portions can be heat welded together after the strip is looped into engagement with the transverse strip on the tie tail. The heat welded strip is then provided with suitable openings for attachment at to two spaced apart button members of a shirt.

These features and advantages of the present invention as well as others will be more fully understood when the following description is read inlight of the accompaning drawings in which.

Figure 1:
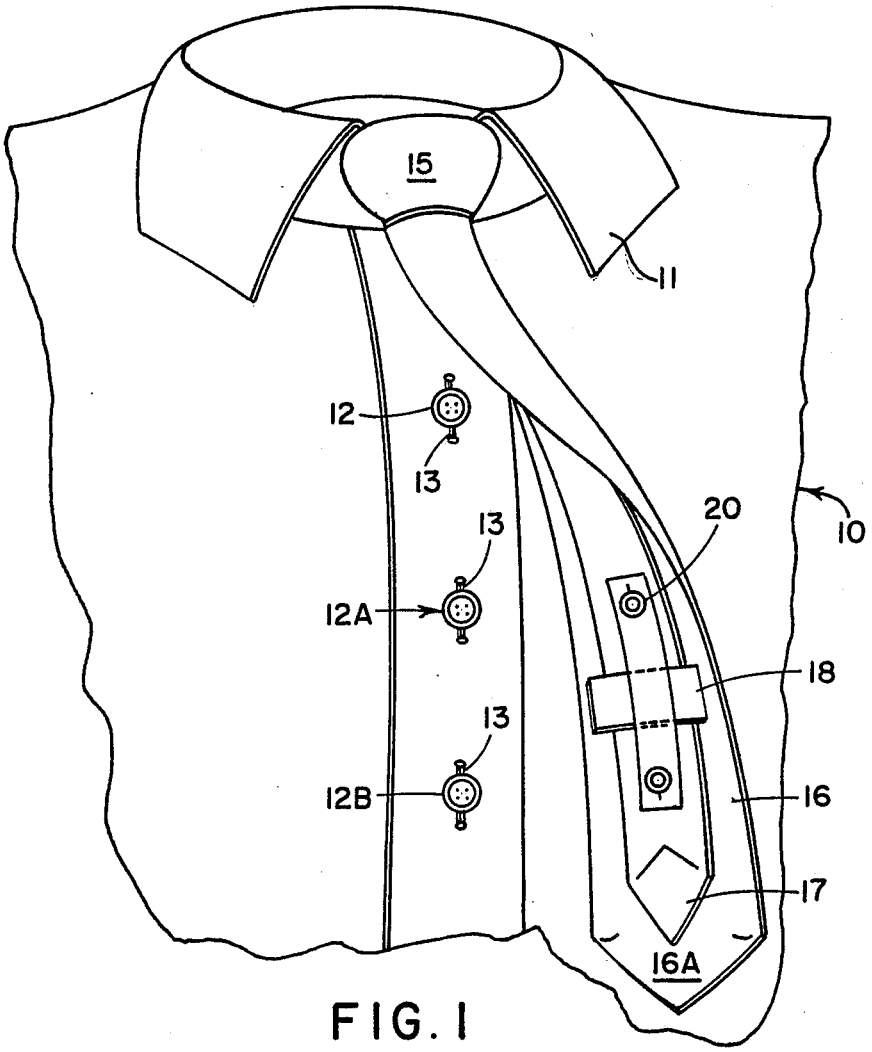
FIG. 1 is a perspective view of a four-in-hand neck tie which is shown with tail portions turned about 180° to illustrate the apparatus of the present invention.
Figure 2:
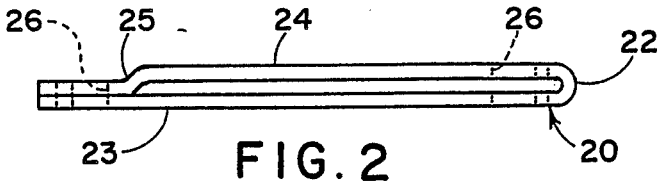
FIG. 2 is a side elevational view of the tie holding apparatus as shown in FIG. 1.
Figure 3:
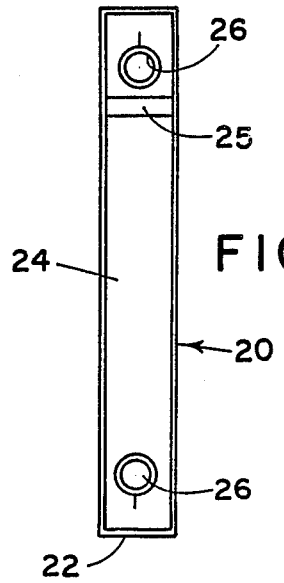
FIG. 3 is a front view of the apparatus shown in FIG. 2.

In FIG. 1 there is illustrated a garment 10 which for the purpose of disclosing the present invention comprises a shirt having the usually collar portion 11 and a spaced apart button members 12 forming fasteners which can pass through button holes 13 that are situated in a fabric strip extending down a front portion of a shirt of which is of per se well known in the art. The four-in-hand neck tie has a middle portion wrapped about the collar and normally hidden in view by the turned down collar portions 11. The tie is knotted in any suitable well known manner the knot being identified by reference numeral 15. The tie thus forms two elongated tail portions the first of which is identified by reference number 17 and comprises a relatively wide tail portion which having a length which is usually longer than a tail portion 16 having a narrower width. Tail portion 16 includes on the back side thereof, which is identified by reference numeral 16A, a transversely extending strip 18 comprised of cloth material and ordinarily positioned at about four to five inches from the terminal end of the portion 16. This strip carries indicia such as trade names, trademarks, etc. This strip is sewn between opposite sides to the wide portion of the tie and forms a middle portion into which there can be inserted the narrow tie tail 17. Tail portion 17 is inserted in the direction of its length behind the strip 18. Arranged in a similar manner to tail portion 17 is a tail tie holding device of the present invention which is identified by reference numeral 20. In the form illustrated in FIGS. 1–3, the device 20 comprises an endless loop of thin plastic material which is preferably transparent. The endless loop is formed by selecting a length of a plastic strip and producing a fold line 22 so that two legs 23 and 24 are formed having equal length. The end portions of legs 23 and 24 are heat welded together at 25. The heat welding process is carried out after one leg is threaded behind strip 18 and the other leg is positioned in front of strip 18. After the heat welding process is completed, the endless loop is retained in a permanent fashion by the cross-strip 18. In the opposite end portions of the plastic strip 20 there is formed an opening 26 which may comprise a slot extending in the direction parallel to the length of the strip or the opening 26. As shown in FIGS. 1–3 an annular opening includes slotted portion projecting therefrom to provide ease of attachment of the plastic strip to button members 27 of the users shirt. As seen from FIG. 1, button members 12A and 12B are selected as the means for attaching the strip to the users shirt. Torsal movements of the user, which normally draw the tie vertically, do not dislodge the tie particularly the knotted portion from its originally positioned site. This is because the plastic strip 20 can slide back and forth along the cross strip 18 as the upper torsal portion of the user undergoes movement. If desired a suitable length of a plastic strip can be attached to two shirt buttons after positioning between strip 18 and tie tail portion 16 without departing from the spirit of the present invention.

Figure 4:
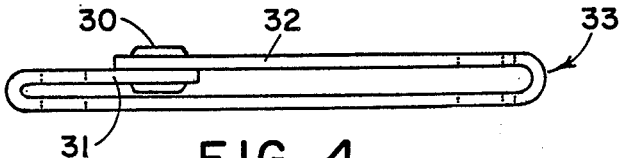
FIG. 4 is a view similar to FIG. 2 illustrating a second embodiment of the present invention.
Figure 5:
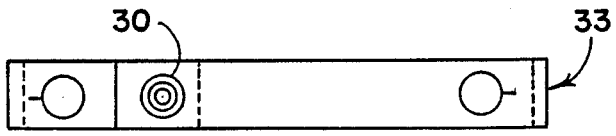
FIG. 5 is a front view of the embodiment of the present invention shown in FIG. 4.

In FIGS. 4 and 5 there is illustrated a second embodiment of the present invention which differs from that described above and shown in FIGS. 1–3 by the use of a releasable fastener 30 to secure end portions 31 and 32 of a plastic strip 33 together after a leg of the strip is slipped between the cross-strip of the tie and the other leg is positioned outside of the cross-strip. In this way the tie retaining device can be removably attached to the cross-strip of any tie.

While the present invention has been described in connection with the preferred embodiment of the various figures, it is to be understood that other similar embodiments may be used or modifications and additions may be made to the described embodiment for performing the same functions of the present invention without deviating therefrom. Therefore, the present invention should not be limited to any single embodiment, but rather construed in breadth and scope in accordance with the recitation of the appended claims.

I claim:

1. In a combination tie restraint apparatus for holding a transversely extending strip secured at spaced apart attachment sites at the back surface of an elongated tie tail end portion of a four-in-hand neck tie along the front portion of a shirt having consecutive uniformly spaced buttons therealong, said tie restraint apparatus comprising an endless loop of flexible strip material for encircling and retention by the transversely extending strip, said loop being folded to form opposite end portions and two legs of equal length extending across opposite face surfaces of the transversely extending strip, each end portion of said loop having an opening therein to releasably receive one of the consecutive buttons on the front portion of the shirt, said loop having a narrow width sufficient to slide back and forth along opposite face surfaces and between the attachment sites of the transversely extending strip while the transversely extending strip can move longitudinally between the legs of said loop to maintain the tail end portion of the neck tie at the front portion of the shirt; said endless loop further including interlocking fastener members for joining terminal ends of said flexible strip material together while the flexible strip material extends along said opposite face surfaces of said strip.

2. The combination tie restraint apparatus according to claim 1 wherein said endless loop includes two preselected lengths of flexible strip material each supported by said fastener members.

3. The combination tie restraint apparatus according to claim 1 wherein said neck tie includes relatively wide and relatively narrow tie tail end portions, and said elongated tie tail end portion comprises the relatively wide tie tail end portion.

4. The combination tie restraint apparatus according to claim 1 wherein said interlocking fastener members are releasable.

* * * * *